US006342000B1

(12) United States Patent
Yan

(10) Patent No.: US 6,342,000 B1
(45) Date of Patent: Jan. 29, 2002

(54) SANDER HAVING A VIBRATING MECHANISM

(76) Inventor: Jason Yan, No. 12, Nei Hu Lane, Guang Hsin Road, Taiping City, Taichung Hsien (TW), 411

( * ) Notice: Subject to any disclaimer, the term of this patent is extended or adjusted under 35 U.S.C. 154(b) by 0 days.

(21) Appl. No.: 09/564,944

(22) Filed: May 5, 2000

(51) Int. Cl.[7] ..... B24B 21/00
(52) U.S. Cl. ..... 451/304; 451/168; 451/300
(58) Field of Search ..... 451/59, 167, 168, 451/299, 300, 304, 310, 296, 297

(56) References Cited

U.S. PATENT DOCUMENTS 3,812,622 A * 5/1974 Parsons ..... 451/449
4,189,872 A * 2/1980 Evans ..... 451/304
5,361,546 A * 11/1994 Jonsson ..... 451/296
5,928,068 A * 7/1999 Matsuda et al. ..... 451/299
6,089,958 A * 7/2000 Costa et al. ..... 451/304

* cited by examiner

*Primary Examiner*—Eileen P. Morgan
(74) *Attorney, Agent, or Firm*—Charles E. Baxley

(57) ABSTRACT

A sander includes a roller rotatably secured to a support, a bracket rotatably supported on the support at a pivot pin, another roller rotatably secured to the bracket, a sander belt engaged around the rollers. One of the rollers is rotated about the support for twisting the sander belt and for removing some of the dust from the sander belt. An actuator includes a rod engaged with the bracket for rotating the bracket about the support. A valve is coupled to the actuator for selectively supplying the air to the actuator via a rotatable spindle and a lever.

5 Claims, 6 Drawing Sheets

SANDER HAVING A VIBRATING MECHANISM

BACKGROUND OF THE INVENTION

1. Field of the Invention

The present invention relates to a sander device, and more particularly to a sander device having a vibrating mechanism.

2. Description of the Prior Art

Typical sander devices comprise an endless sander belt engaged around one or more rollers so as to be driven by the rollers and in order to sand or work onto the work pieces. Both the rollers and the sander belt may not be rotated or vibrated such that the sander belt may not be adjusted or changed relative to the work pieces.

The present invention has arisen to mitigate and/or obviate the afore-described disadvantages of the conventional sander devices.

SUMMARY OF THE INVENTION

The primary objective of the present invention is to provide a sander having a vibrating mechanism for vibrating the sander belt and for removing some of the dust from the sander belt.

In accordance with one aspect of the invention, there is provided a sander comprising a support, a first roller rotatably secured to the support at a pivot shaft, a bracket rotatably supported on the support at a pivot pin, a second roller rotatably secured to the bracket at a pivot axle, a sander belt engaged around the first roller and the second roller. and means for rotating the bracket about the pivot pin to twist the sander belt.

The rotating means includes an actuator disposed on the support, the actuator includes a rod extended therefrom and engaged with the bracket for rotating the bracket about the pivot pin. The bracket includes a pole extended therefrom and engaged with the rod for allowing the actuator to rotate the bracket about the pivot pin via the rod and the pole. The actuator includes a follower secured to the rod, the follower includes a cavity formed therein for receiving the pole. A spring biasing device may further be provided for biasing or for recovering the rod backward to the original position.

The rotating means includes a valve device coupling the actuator to an air source, and the valve device includes means for selectively supplying the air to the actuator. The valve device includes a first port coupled to the actuator and a second port for coupling to the air source, the selectively supplying means includes a spindle rotatably received in the valve device, the spindle includes a groove formed therein for selectively communicating the first and the second ports with each other when the spindle is rotated relative to the valve device. The valve device includes an air exit, the spindle includes a recess for selectively communicating the first port and the air exit of the valve device with each other when the spindle is rotated relative to the valve device.

The selectively supplying means includes a means for actuating the spindle to rotate relative to the valve device. The actuating means includes a lever secured to the spindle, and an air outlet directed toward the lever to rotate the spindle with the lever. The lever includes a disc attached thereto and facing toward the air outlet for allowing the air from the air outlet to act onto the disc of the lever.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
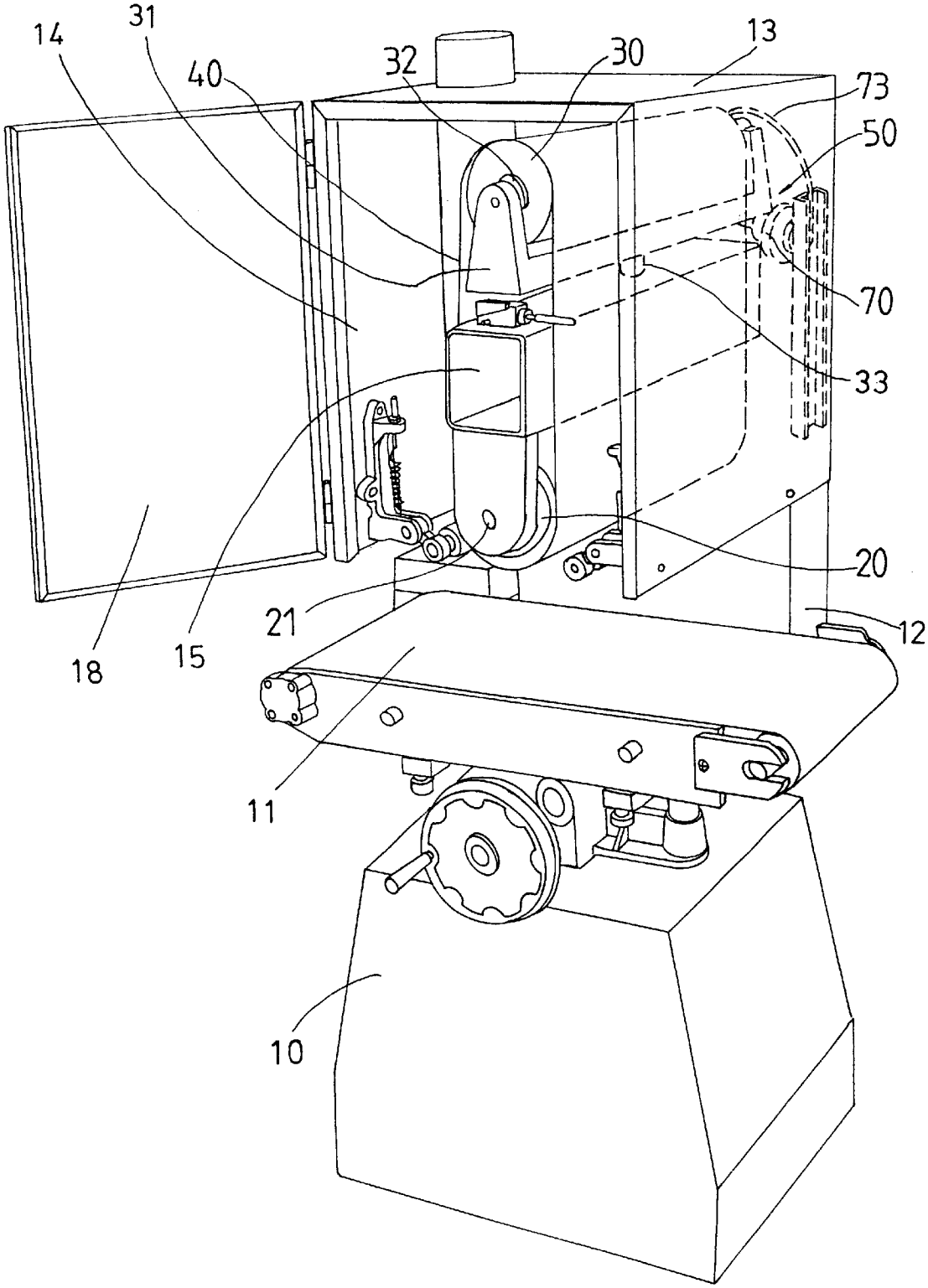
FIG. 1 is a front perspective view of a sander in accordance with the present invention.

Referring to the drawings, and initially to FIG. 1, a sander in accordance with the present invention comprises a stand 10 including an endless sander member 11 movably or operatively provided thereon for sanding purposes, and including a wall 12 extended upward from the rear portion thereof for supporting a housing 13 thereon. The housing 13 includes a support 15 extended inward of the inner chamber 14 of the housing 13, and includes a cover 18 pivotally secured thereto for enclosing the chamber 14 of the housing 13. A roller 20 is rotatably secured to the support 15 at a pivot shaft 21. Another roller 30 is rotatably secured on a bracket 31 at a pivot axle 32. A sander belt, particularly an endless sander belt 40 is engaged over the rollers 20, 30 so as to be moved or actuated by the rollers 20, 30. A typical motor or the like may be coupled to one of the rollers 20, 30 for rotating the rollers 20, 30 and for driving the sander belt 40 to work onto the work pieces. The bracket 31 includes a pin 33 extended downward therefrom and rotatably engaged into the support 15, such that the pin 33 is formed as a pivot pin 33 for pivotally or rotatably securing the bracket 31 to the support 15, and such that the bracket 31 and the roller 30 is rotatable relative to the support 15 about the pivot pin 33.

Figure 2:
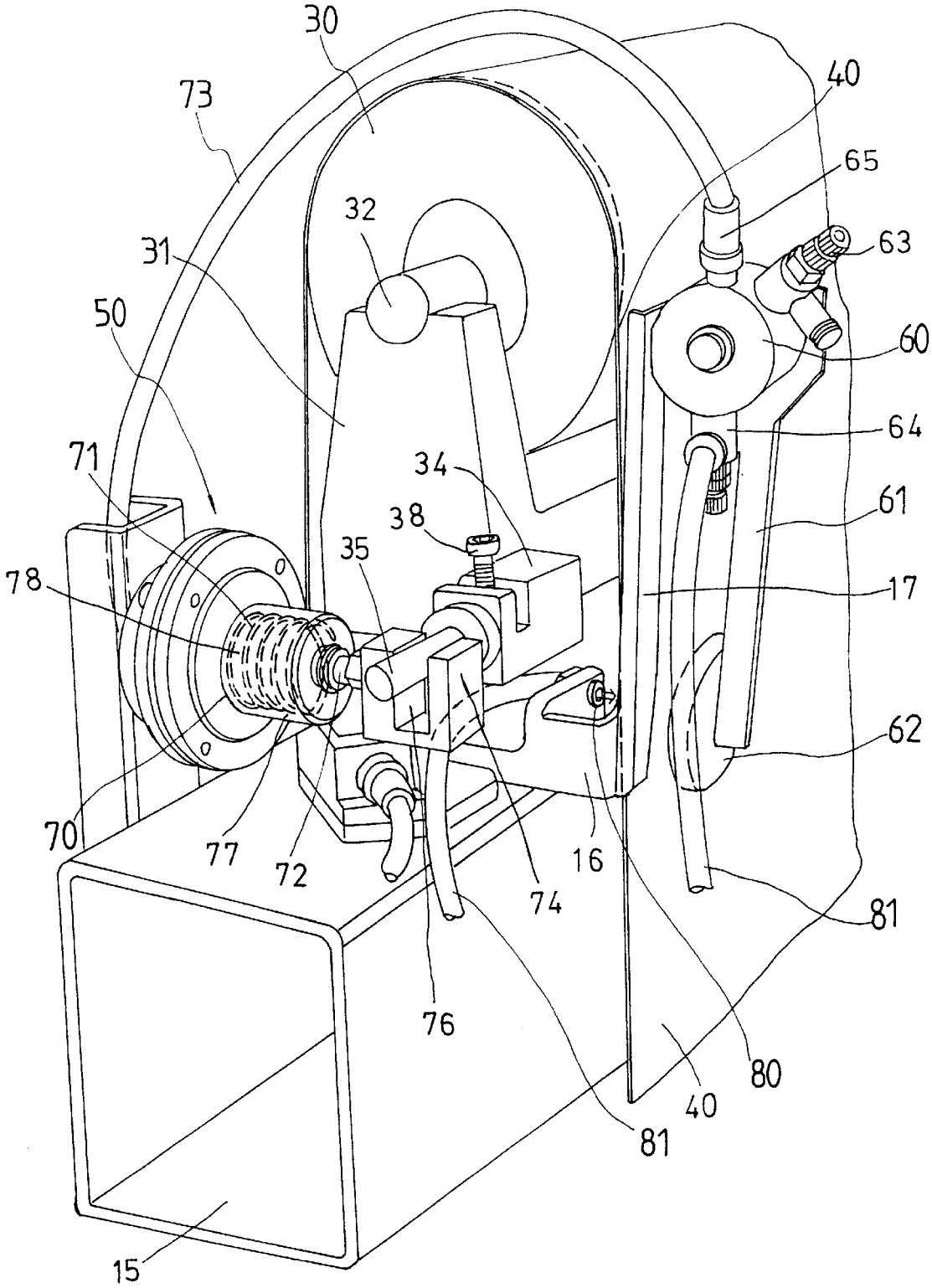
FIG. 2 is a partial rear perspective view of the sander.
Figure 3:
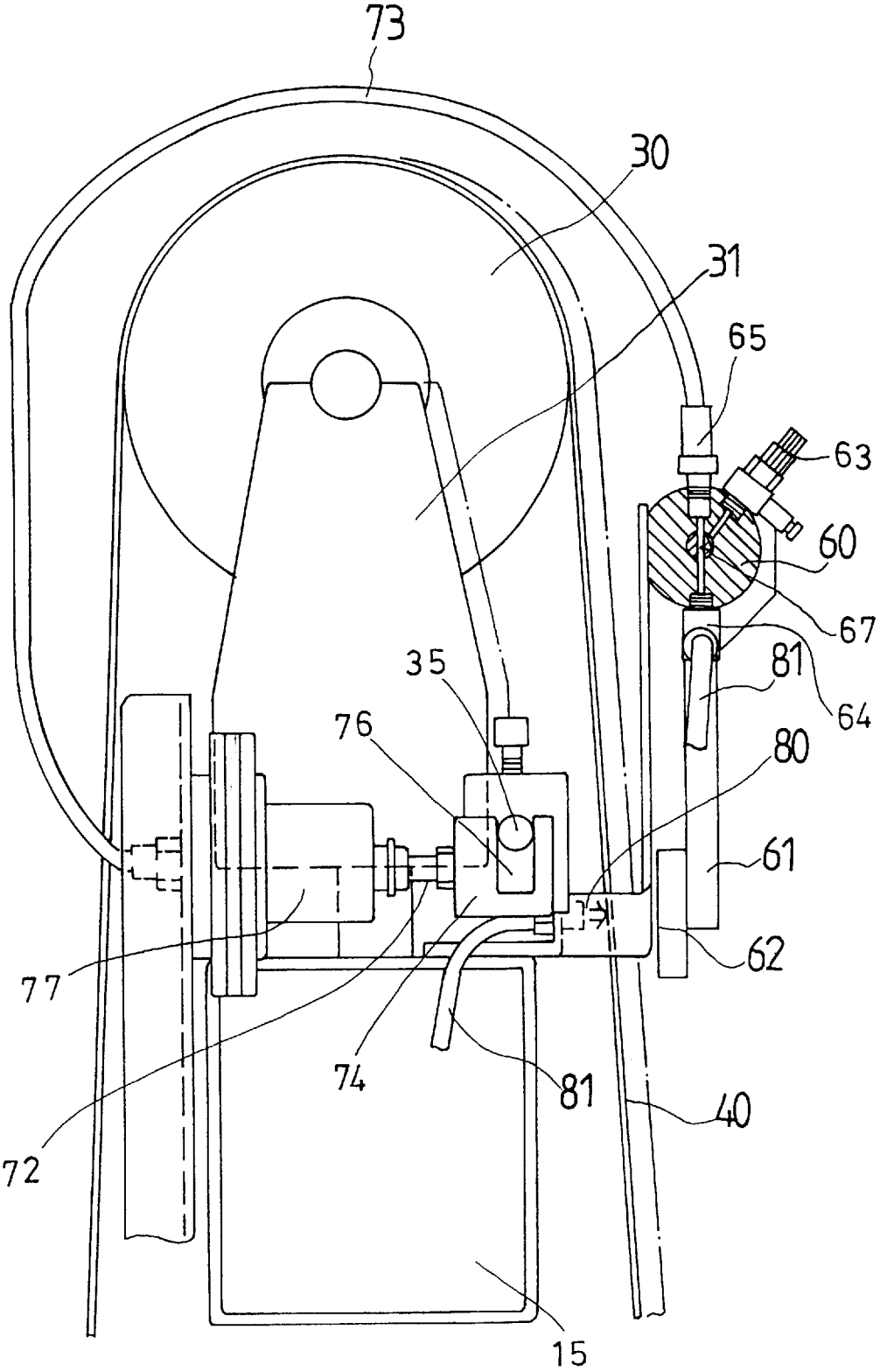
FIG. 3 is a partial rear plan view of the sander.
Figure 4:
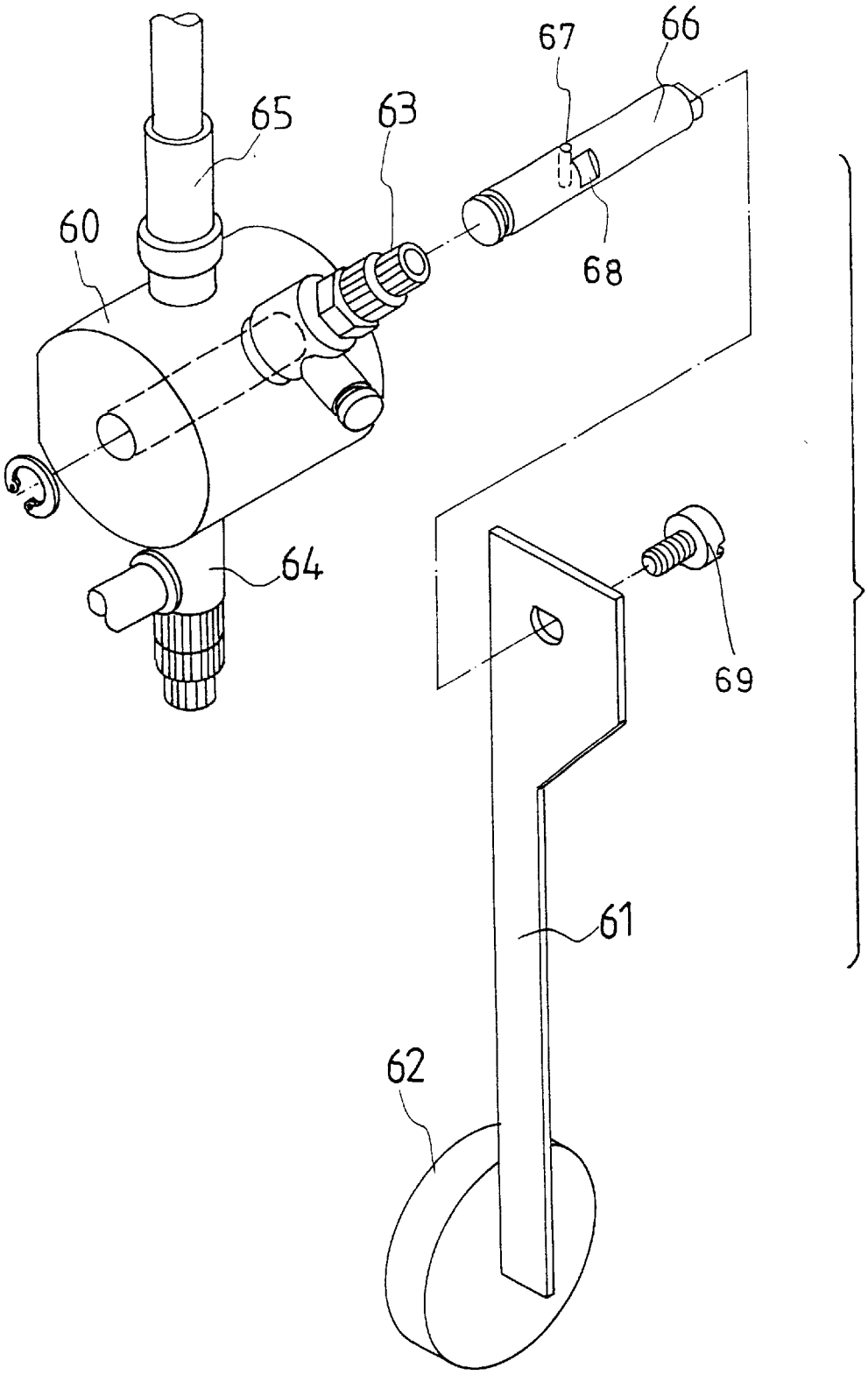
FIG. 4 is a partial exploded view of the control device for the sander.

Referring next to FIGS. 2–4, a seat 16 is disposed on the rear portion of the support 15 and a post 17 is secured to or extended upward from the block 16. An air outlet 80 is disposed on the seat 16 and is coupled to a pressurized air source, such as an air pump or a pressurized air container, etc., via a hose 81, for receiving the pressurized air from the pressurized air source. The bracket 31 includes an extension 34 secured thereto or extended therefrom. A pole 35 is secured to the extension 34 with one or more fasteners 38 or is extended from the extension 34. An actuator 70, such as a hydraulic or pneumatic cylinder, is secured on the support 15 and includes a spring 71 received in a casing 77 thereof and includes rod or a piston rod 72 extended outward through the casing 77. A follower 74 is secured to the rod 72 so as to be moved and actuated by the actuator 70 via the rod 72. The follower 74 includes a cavity 76 formed therein for receiving the pole 35 and for rotating the bracket 31 about the pivot pin 33. The actuator 70 includes a piston or a slide 78 slidably received in the casing 77 and engaged with the spring 71 which may bias or recover the slide 78 to move in a direction away from the pole 35.

A valve device 60 is secured on the support 15 at the post 17 and includes an air exit 63 and includes a port 64 coupled to the pressurized air source, such as the air pump or the pressurized air container, etc., via another hose 81, for receiving the pressurized air from the pressurized air source. The valve device 60 further includes another port 65 coupled to the actuator 70 with a hose 73 for selectively supplying the pressurized air to the actuator 70. As best shown in FIG.

4, a valve spindle 66 is rotatably received in the valve device 60 and includes a groove 67 formed therein for selectively communicating the ports 64, 65 with each other (FIG. 3) and for supplying the pressurized from the port 64 to the actuator 70 via the port 65. The valve spindle 66 further includes a recess 68 formed therein for selectively communicating the air exit 63 and the port 64 with each other (FIG. 6) for allowing the air from the actuator 70 to flow out of the valve device 60 via the air exit 63. A lever 61 has one end secured to the valve spindle 66 with one or more fasteners 69 and includes a cap or a hood or a disc 62 attached to the other end thereof and directed toward the air outlet 80 so as to be actuated by the air flowing outward from the air outlet 80.

In operation, as shown in FIGS. 2 and 3, at the beginning, the sander belt 40 that is engaged over the rollers 20, 30 has a portion, particularly an edge portion, disposed between the air outlet 80 and the disc 62 of the lever 61, such that the lever 61 and thus the valve device 60 may not be actuated. At this moment, the ports 64, 65 of the valve device 60 are communicated with each other by the groove 67 of the valve spindle 66, such that the pressurized air may be supplied to the actuator 70. The rod 72 thus may be moved by the actuator 70 in order to rotate the bracket 31 and the roller 30 about the pivot pin 33 via the follower 74 and the pole 35 of the bracket 31. When the roller 30 is rotated about the pivot pin 33, the sander belt 40 may be moved or disengaged from the air outlet 80 and the disc 62, such that the air from the air outlet 80 may blow or act onto the disc 62 of the lever 61 in order to rotate the valve spindle 66 via the lever 61.

Figure 5:
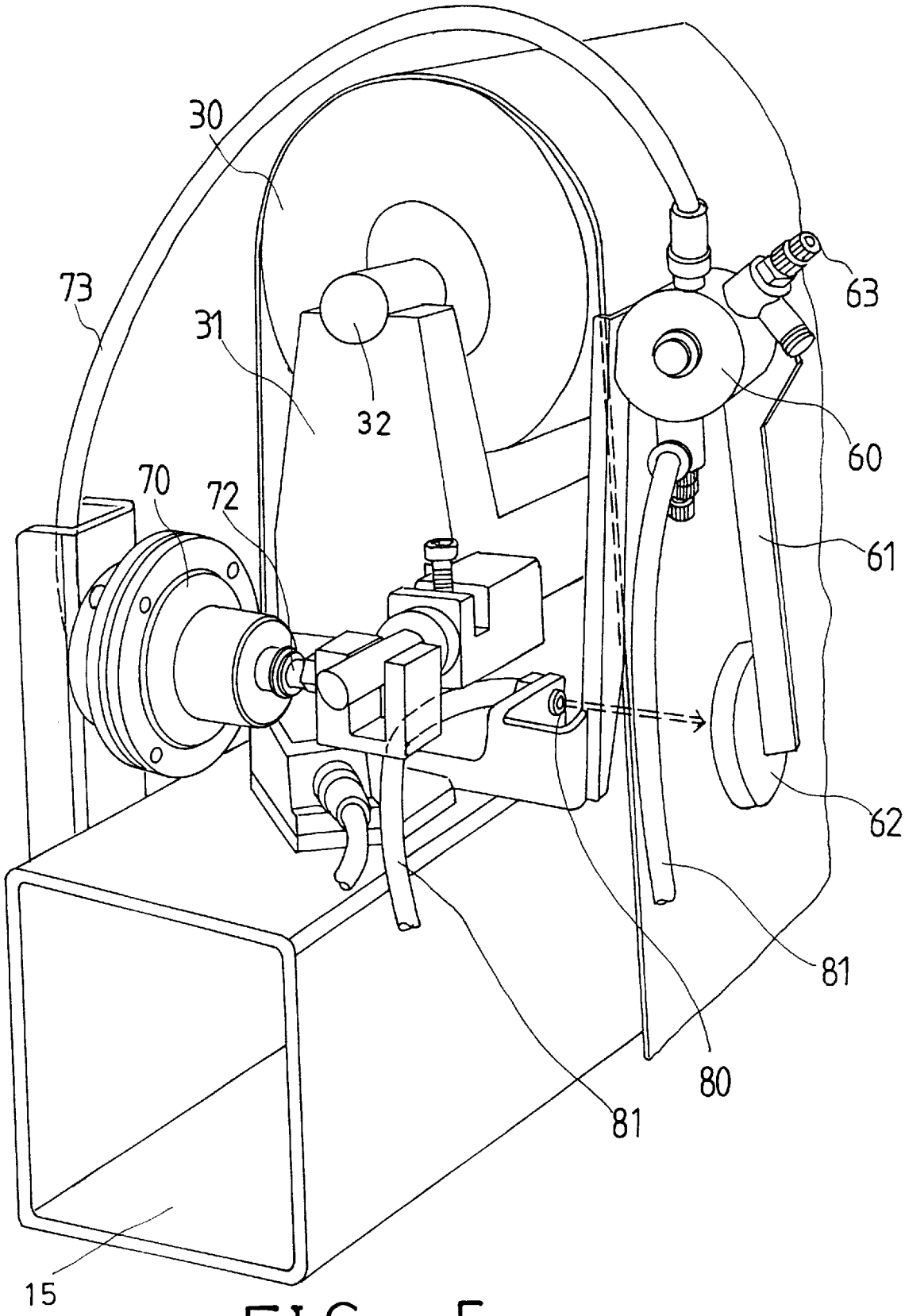
FIGS. 5 and 6 are a partial rear perspective view and a partial rear plan view of the sander respectively, similar to FIGS. 2 and 3 respectively, illustrating the operation of the sander.
Figure 6:
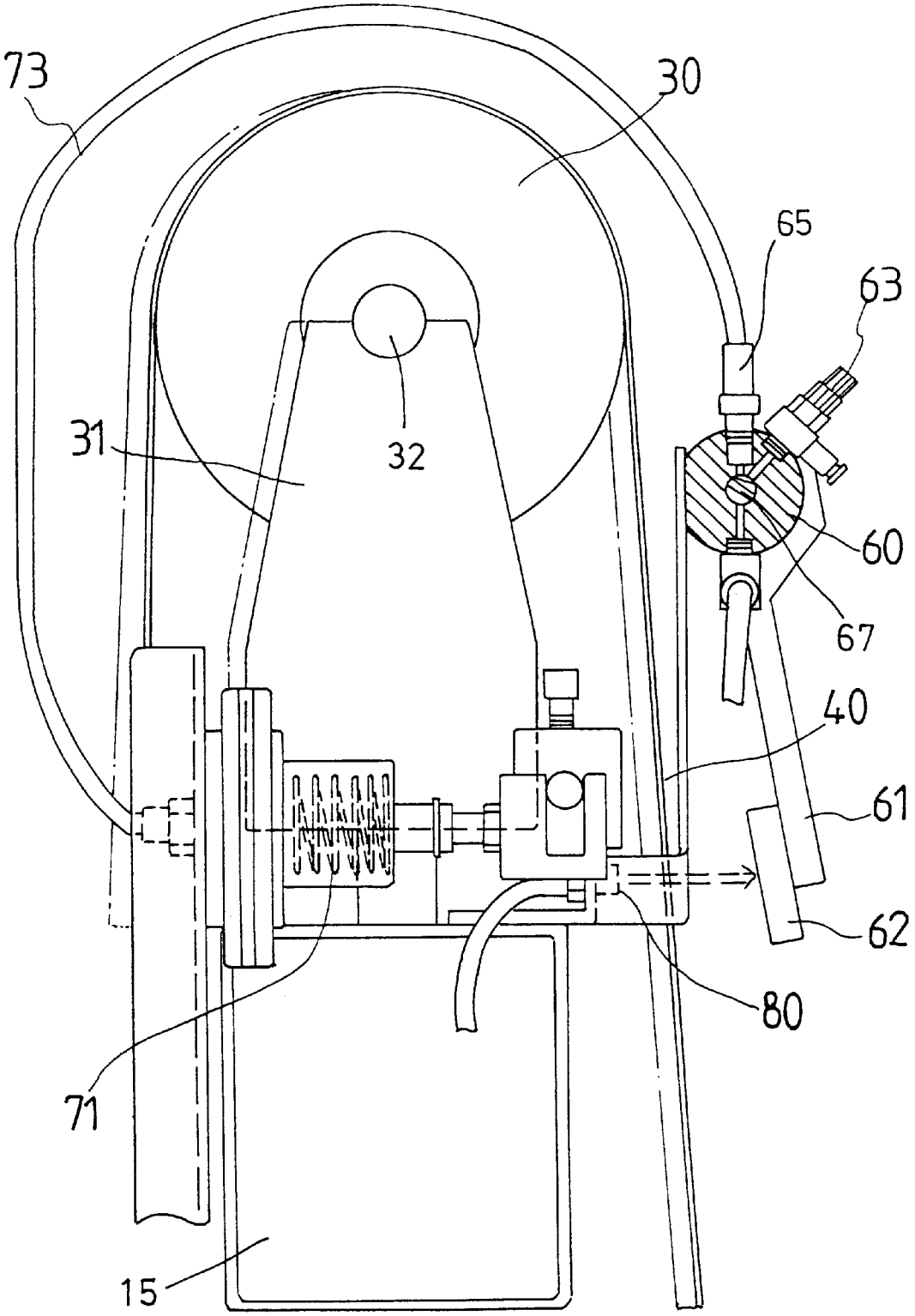

As shown in FIGS. 5 and 6, the groove 67 of the valve spindle 66 may thus be disengaged from the ports 64, 65, and the recess 68 of the valve spindle 66 may thus be used for communicating the air exit 63 and the port 64 with each other (FIG. 6) for allowing the air from the actuator 70 to flow out of the valve device 60 via the air exit 63. The pressurized air source thus may not be supplied to the actuator 70. However, the spring 71 may bias and may recover the rod 72 backward to the original position, such that the bracket 31 and the roller 30 may be rotated about the pivot pin 33 back to the original position, and such that the sander belt 40, particularly the edge portion of the sander belt 40, may be moved to the position located between the air outlet 80 and the disc 62 again in order to prevent the disc 62 from being actuated by the air from the air outlet 80. The rod 72 may be moved and biased backward to the original position by the spring 71, because the actuator 70 is communicating with the air exit 63 of the valve device 60 and because the air in the actuator 70 may flow out through the air exit 63 of the valve device 60.

When the air outlet 80 is blocked by the sander belt 40, the disc 62 and the lever 61 may be moved or rotated downward to the downward depending position, in order to communicate the groove 67 thereof with the ports 64, 65, such that the actuator 70 may be actuated to move the pole 35 and the rod 72 and to rotate the bracket 31 and the roller 30 about the pivot pin 33 again. The roller 30 thus may be rotated about the pivot pin 33 in a reciprocating action. The sander belt 40 thus may also be twisted or moved or vibrated in a reciprocating action, such that some of the dust may be removed from the sander belt 40. When the portion of the sander belt 40 that is engaged on the roller 30 is twisted by the roller 30 in a reciprocating action, the other portion of the sander belt 40 that is engaged on the roller 20 may also be slightly twisted for allowing the sander belt 40 to act onto the work pieces at different working directions, for example. The sander of the invention may further provide a limiting wall device provided beside the sander belt 40 for preventing the sander belt 40 from being disengaged from the rollers 20, 30.

When the sander belt 40 is located between the air outlet 80 and the disc 62 (FIGS. 2, 3), the air from the air outlet 80 may blow onto the inner portion of the sander belt 40 in order to vibrate the sander belt 40 and in order to indirectly blow or to remove some of the dust from the sander belt 40. When the sander belt 40 is disengaged from the air outlet 80 and the disc 62 (FIGS. 5, 6), the air from the air outlet 80 may blow onto the disc 62 in order to rotate the roller 30 and the sander belt 40 via the lever 61. At this moment, the air from the air exit 63 may flow outward into the chamber 14 of the housing 13 (FIG. 1) in order to blow or to remove some of the dust from the sander belt 40.

Accordingly, the sander in accordance with the present invention includes a vibrating mechanism for vibrating the sander belt and for removing some of the dust from the sander belt.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander comprising:

a support, a first roller rotatably secured to said support at a pivot shaft, a bracket rotatably supported on said support at a pivot pin located between a first end and a second end of said bracket, a second roller rotatably secured to said bracket at a pivot axle, a sander belt engaged around said first roller and said second roller, an actuator disposed on said support at said second end and including a rod extended therefrom for engaging with said bracket at said second end and extendible outward to actuate said bracket to rotate about said pivot pin.

2. The sander according to claim 1, wherein said actuator includes a follower secured to said rod, said follower includes a cavity formed therein, said bracket includes a pole extended therefrom and engaged in said cavity of said follower, for allowing said follower and said rod of said actuator to rotate said pole of said bracket and to rotate said bracket about said pivot pin.

3. The sander according to claim 1 further comprising means for biasing said rod inward of said actuator.

4. The sander according to claim 1 further comprising a valve device including a first port coupled to said actuator and including a second port for coupling to an air source, and a spindle rotatably received in said valve device and including a groove formed therein for selectively communicating said first and said second ports with each other when said spindle is rotated relative to said valve device, for allowing an air from the air source to flow into said actuator via said second port and said groove of said spindle and said first port of said valve device, in order to actuate said rod of said actuator to rotate said bracket.

5. The sander according to claim 4, wherein said valve device includes an air exit, said spindle includes a recess formed therein for selectively communicating said first port and said air exit of said valve device with each other when said spindle is rotated relative to said valve device.

* * * * *